US005486836A

United States Patent [19]

Kuffner et al.

[11] Patent Number: 5,486,836

[45] Date of Patent: Jan. 23, 1996

[54] METHOD, DUAL RECTANGULAR PATCH ANTENNA SYSTEM AND RADIO FOR PROVIDING ISOLATION AND DIVERSITY

[75] Inventors: Stephen L. Kuffner, Algonquin; Scott N. Carney, Palatine; Eric L. Krenz, Crystal Lake, all of Ill.

[73] Assignee: Motorola, Inc., Schaumburg, Ill.

[21] Appl. No.: 389,540

[22] Filed: Feb. 16, 1995

[51] Int. Cl.[6] ..... H01Q 1/38

[52] U.S. Cl. ..... 343/700 MS; 343/702; 343/853

[58] Field of Search ..... 343/700 MS, 702, 343/725, 830, 846, 844, 853, 876; H01Q 1/38

[56] References Cited

U.S. PATENT DOCUMENTS

| | | | |
|---|---|---|---|
| 4,538,153 | 8/1985 | Taga | 343/700 MS |
| 5,201,065 | 4/1993 | Niehenke | 343/700 MS |
| 5,223,848 | 6/1993 | Rammos et al. | 343/853 |
| 5,270,722 | 12/1993 | Delestre | 343/700 MS |
| 5,371,507 | 12/1994 | Kuroda et al. | 343/700 MS |
| 5,410,322 | 4/1995 | Sonoda | 343/700 MS |

OTHER PUBLICATIONS

Yeshihide Yanmada, Yeshie Ebine and Kenichi Tsunekawa, "Base and Mobile Station Antennas for Land Mobile Radio Systems" Invited Papers, Special Issue on Mobile Communications, Mar. 11, 1991, pp. 1547–1555.

*Primary Examiner*—Donald T. Hajec
*Assistant Examiner*—Tan Ho
*Attorney, Agent, or Firm*—Darleen J. Stockley

[57] ABSTRACT

The present invention provides a method, dual rectangular patch antenna system, and radio for providing isolation and diversity while eliminating the need for a diplexer or a second transmit/receive switch. The dual rectangular patch antenna system comprises a first rectangular patch antenna (202), a second rectangular patch antenna (204), and a switch (206). Receive path diversity is provided by switching between the first rectangular patch antenna (202) and the second rectangular patch antenna (204).

16 Claims, 6 Drawing Sheets

FIG.1
—PRIOR ART—
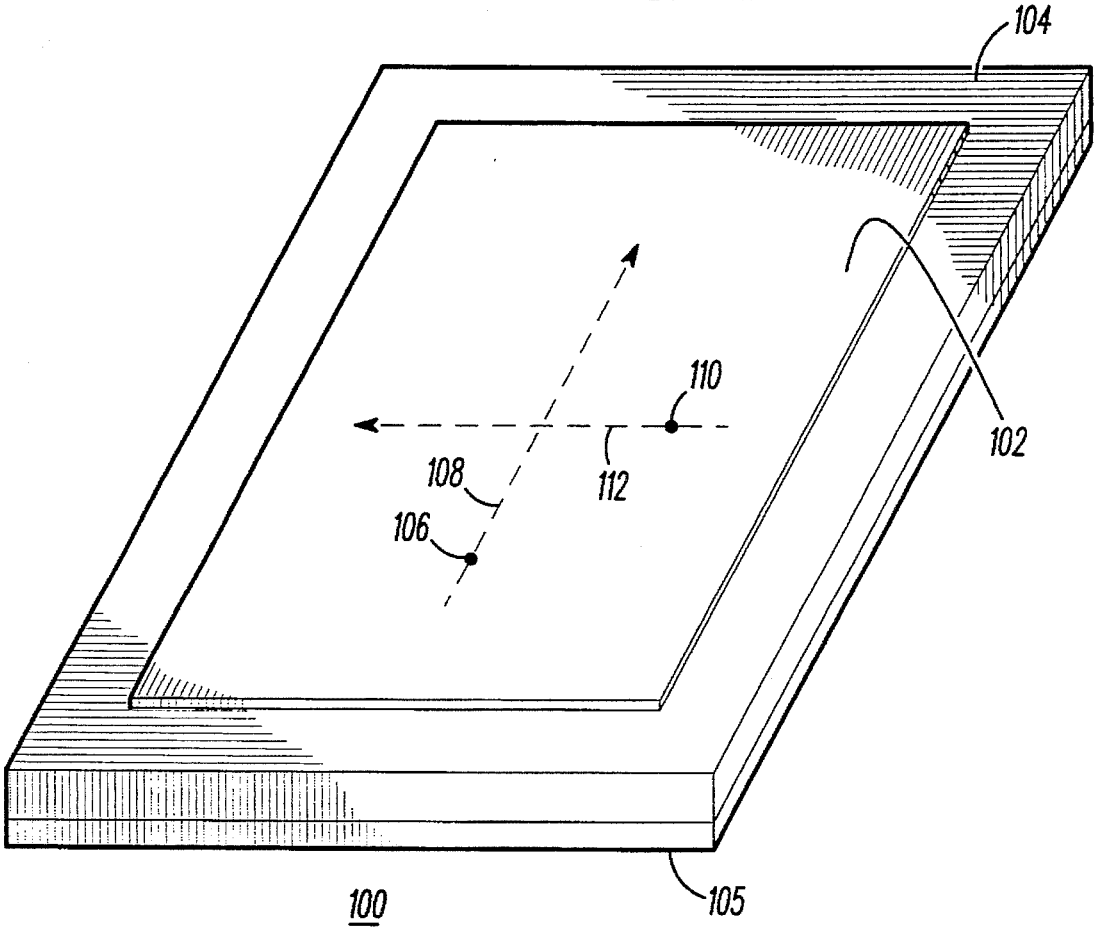
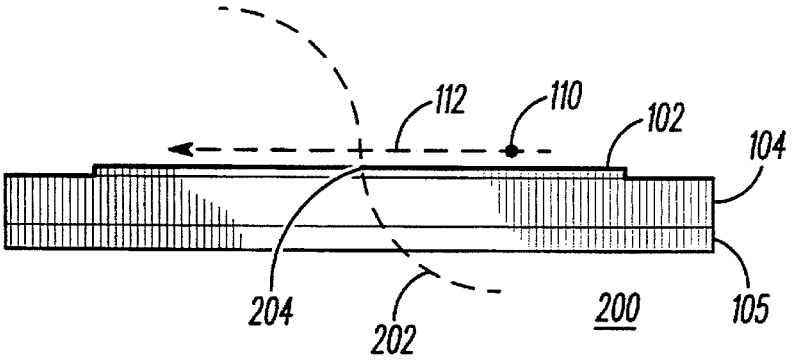
FIG.2
—PRIOR ART—

METHOD, DUAL RECTANGULAR PATCH ANTENNA SYSTEM AND RADIO FOR PROVIDING ISOLATION AND DIVERSITY

FIELD OF THE INVENTION

The present invention relates generally to antenna systems, and more particularly to patch antenna systems with diversity.

BACKGROUND OF THE INVENTION

In microwave communications, the strength of a microwave signal can decrease as a result of communication channel impairments due to natural causes such as precipitation, humidity, or terrain and man-made causes such as structures which scatter or block the microwave signal. In some situations the decrease in signal strength prevents reliable communication. Diversity provides multiple opportunities to access the microwave signal and improve the probability of reliable communication. The multiple opportunities to access the microwave signal may be implemented by exploiting redundancies in the time, frequency and/or field domains of the signal, where field domains consist of the spatial, polarization, and radiation pattern attributes of the signal.

A single dual-mode patch antenna, which is a microstrip antenna excited to generate two orthogonal polarizations, has been used for diversity in Motorola's 2.45 GHz radio local area network, RLAN. The use of a single-mode patch or similar antennas known in the art such as an inverted-F antenna together with a whip antenna is common practice for obtaining field diversity on portable radio handsets, especially in the Japanese cellular arena.

Some emerging 1.9 GHz personal communication systems, PCSs, such as the Personal Access Communications System, PACS, air interface require that the subscriber unit provide field diversity for both transmit and receive. Typical full-duplex radios with this requirement would employ an antenna switch to select from one of the two antennas providing the field diversity and a diplexer that operates to reduce the coupled energy from the transmitter to the receiver. In a two frequency full-duplex system, diplexing allows a transmitter signal and a receiver signal to be coupled in a manner that does not degrade either signal. With knowledge of the filter impedance characteristics, controlled length transmission lines are used to provide the proper impedance for both transmitter and receiver filters. This impedance isolation is necessary for efficient operation. The filters provide signal isolation by reducing the amount of receiver signal lost to the transmitter and the amount of transmitter signal lost to the receiver. This diplexing operation imposes constraints on the circuit board layout and adds complexity to the transmit and receive filter designs, generally leading to increased insertion loss and the requirement for controlled-phase-length transmission lines between the filters. Time-duplexed systems could replace the diplexer with a second switch to select transmit or receive, but this adds an additional insertion loss to both the transmit and receive paths.

Accordingly, there is a need for a method, dual rectangular patch antenna system, and radio for providing isolation and diversity while eliminating the need for a diplexer or a second transmit/receive switch.

BRIEF DESCRIPTION OF THE DRAWINGS

FIG. 1 is a prior art diagram of a dual-mode patch antenna with two feedpoints.

FIG. 2 is a prior art diagram of a voltage distribution along the second mode polarization in the batch antenna of FIG. 1.

DETAILED DESCRIPTION OF A PREFERRED EMBODIMENT

Figure 3:
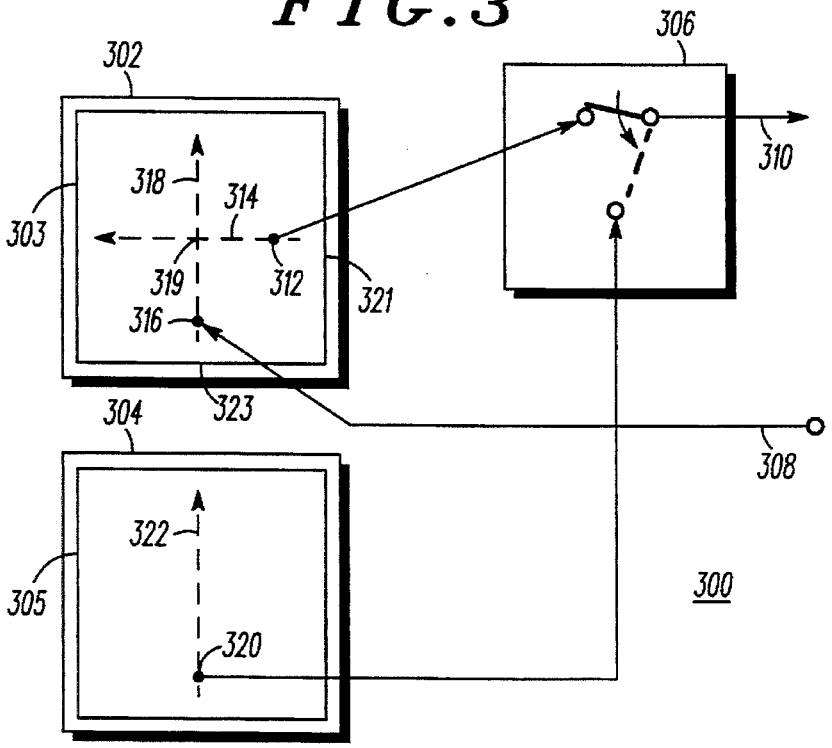
FIG. 3 is a diagram of one embodiment of a dual rectangular patch antenna system for providing isolation and diversity in accordance with the present invention.

Generally, the present invention provides a method, dual rectangular patch antenna system, and radio for providing isolation and diversity while eliminating the need for a diplexer or a second transmit/receive switch.

FIG. 1, numeral 100, is a prior art diagram of a dual-mode patch antenna with two feedpoints. The location of the feedpoint is critical since it directly affects the antenna's polarization and impedance. A feedpoint is typically a connection of a center conductor of a coaxial cable to a conducting layer and a connection of a shield of the coaxial cable to a ground plane, with the coaxial cable continuing away from the patch beneath the ground plane. A patch (102) in the patch antenna (100) is the conducting layer to which the center conductor is connected, and the ground plane (105) is the second conducting layer. The dielectric (104) is a nonconducting material layer, which may be air or some ceramic or fiber/resin composite, between the patch (102) and the ground plane (105). A first mode feedpoint (106) provides a first mode polarization (108), and a second mode feedpoint (110) provides a second mode polarization (112) orthogonal to the first mode polarization (108). The arrowed lines denoting modes' polarizations in FIGS. 1 through 6 show the polarization of the relevant mode's radiated electric field in the far-field zone along a central axis perpendicular to the plane of the patch conductor.

FIG. 2, numeral 200, is a prior art diagram of a voltage distribution (202) along the second mode polarization in the patch antenna of FIG. 1. In the present invention, the patch antenna (100) takes advantage of an isolation between the first mode feedpoint (106) and the second mode feedpoint (110) to serve as a diplexing connection of transmit and receive filters in a radio frequency front end of a radio. In practice, greater than 30 dB of isolation can be provided between the feedpoints (106 and 110) across a given bandwidth centered on the operating frequency, due to the existence of a voltage null (204) in each mode's voltage distribution in the middle of the patch along a line perpendicular to that mode's polarization. This would allow direct connection of the filters to the antenna without requiring controlled phase length transmission lines between the filters to provide the necessary loading. The narrow bandwidth problem typically associated with a microstrip patch may be overcome by tailoring the dimensions of the patch to be resonant at the center frequency of the receive band for the receive polarization and resonant at the center frequency of the transmit band for the transmit polarization. Since the transmit and receive filters no longer need to be diplexed, the patch isolation could also allow for lower order filters, which would increase the sensitivity of the receive path and the efficiency of the transmit path. Because a patch antenna can be fabricated using printed circuit board techniques, the isolation between second mode and first mode polarizations of the patch antenna is not only very high, but also very tightly controlled and predictable. The isolation bandwidth typically exceeds the impedance bandwidth of the antenna.

Typical dimensions for a 2.45 GHz copper patch are 36 mm×36 mm, on a typical dielectric of a 3 mm thick glass/Teflon layer having a dielectric constant of 2.55.

Figure 4:
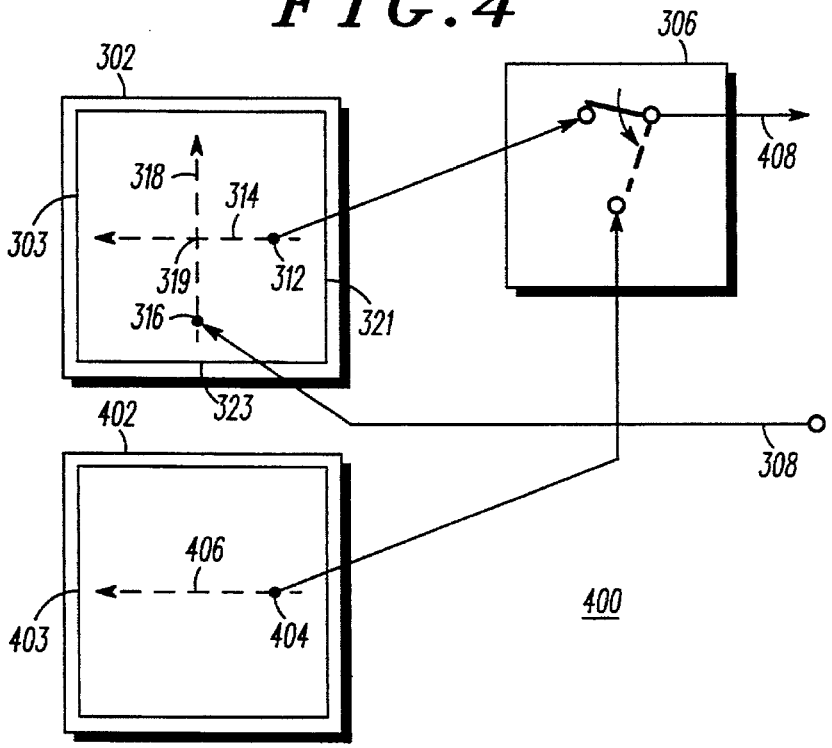
FIG. 4 is a diagram of a second embodiment of a dual rectangular patch antenna system for providing isolation and diversity in accordance with the present invention.

FIG. 3, numeral 300, is a diagram of one embodiment of a dual rectangular patch antenna system for providing isolation and diversity in accordance with the present invention, and FIG. 4, numeral 400, is a diagram of a second embodiment of a dual rectangular patch antenna system for providing isolation and diversity in accordance with the present invention. Both systems (300 and 400) provide diversity for receive only and comprise a first rectangular patch antenna (302), a second rectangular patch antenna (304 and 402), and a switch (306). The difference between the systems (300 and 400) is in the second rectangular patch antenna (304 and 402).

The first rectangular patch antenna (302) has a top layer that is a substantially planar conductive rectangular first patch (303) with four coplanar sides, a first midline, and a second midline. The first midline is orthogonal to a first side of the first patch, and the second midline is parallel to the first side of the first patch and intersects the first midline at a center of the first patch. The first patch (303) comprises a first mode feedpoint (316) for providing a first mode polarization (318) for a transmit path (308) and a second mode feedpoint (312) for providing a second mode polarization (314) for a receive path, which is orthogonal to the first mode polarization (318). The first mode feedpoint (316) and the second mode feedpoint (312) are located such that an isolation is provided by a voltage null of the first mode polarization along the second midline and a voltage null of the second mode polarization along the first midline. The first mode feedpoint (316) is located on the first midline between the first side (323) and the center (319) of the first patch, and the second mode feedpoint (312) is located on the second midline between a second side (321) and the center (319) of the first patch. The first side (323) is adjacent and orthogonal to the second side (321).

In FIG. 3 the second rectangular patch antenna (304) is spatially separated from the first rectangular patch antenna (302) and has a top layer that is a substantially planar conductive rectangular second patch (305). The second patch (305) comprises a third mode feedpoint (320) for providing a third mode polarization (322) for the receive path (310). The third mode polarization (322) is orthogonal to the second mode polarization (314). This arrangement provides polarization as well as space diversity in the receive path (310). The transmit path (308) is devoid of switches and diplex circuits reducing insertion loss by increasing the radiated power for a given transmitter output. In a time-duplexed system, transmit-to-receive isolation is optimized by setting the antenna switch to select the first rectangular patch antenna (302) during transmit operation.

The preferred embodiment for transmit-to-receive isolation in a full-duplex system is depicted in FIG. 4. The second rectangular patch antenna (402) is spatially separated from the first rectangular patch antenna (302) and has a top layer that is a substantially planar conductive rectangular second patch (403). The second patch (403) comprises a third mode feedpoint (404) providing a third mode polarization (406) orthogonal to the first mode polarization (318). The third mode feedpoint (404) is connected to the switch (306) for diversity. While spatial diversity is maintained in the receive path (408), the benefit of polarization diversity is not.

The switch (306) is operably coupled to select one of the second mode feedpoint of the first rectangular patch antenna and the third mode feedpoint of the second rectangular patch antenna. The selection is made based on a predetermined signal quality. Well known diversity algorithms may use received signal strength indication, RSSI, to determine the best antenna to use. The switch (306) provides spatial diversity in the receive path. The RF switch (306) can be implemented using PIN diode circuits or GaAs FET switching circuits as is well known in the art.

Figure 5:
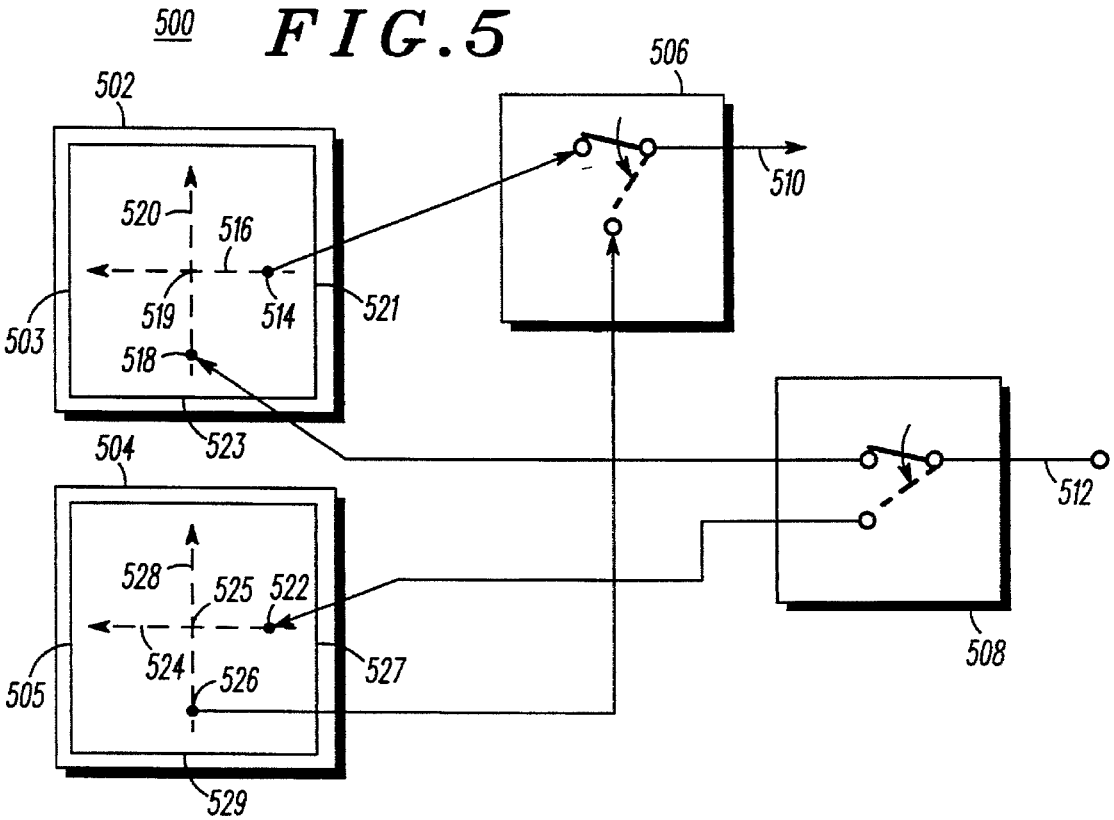
FIG. 5 is a diagram of a third embodiment of a dual rectangular patch antenna system for providing isolation and diversity in accordance with the present invention.
Figure 6:
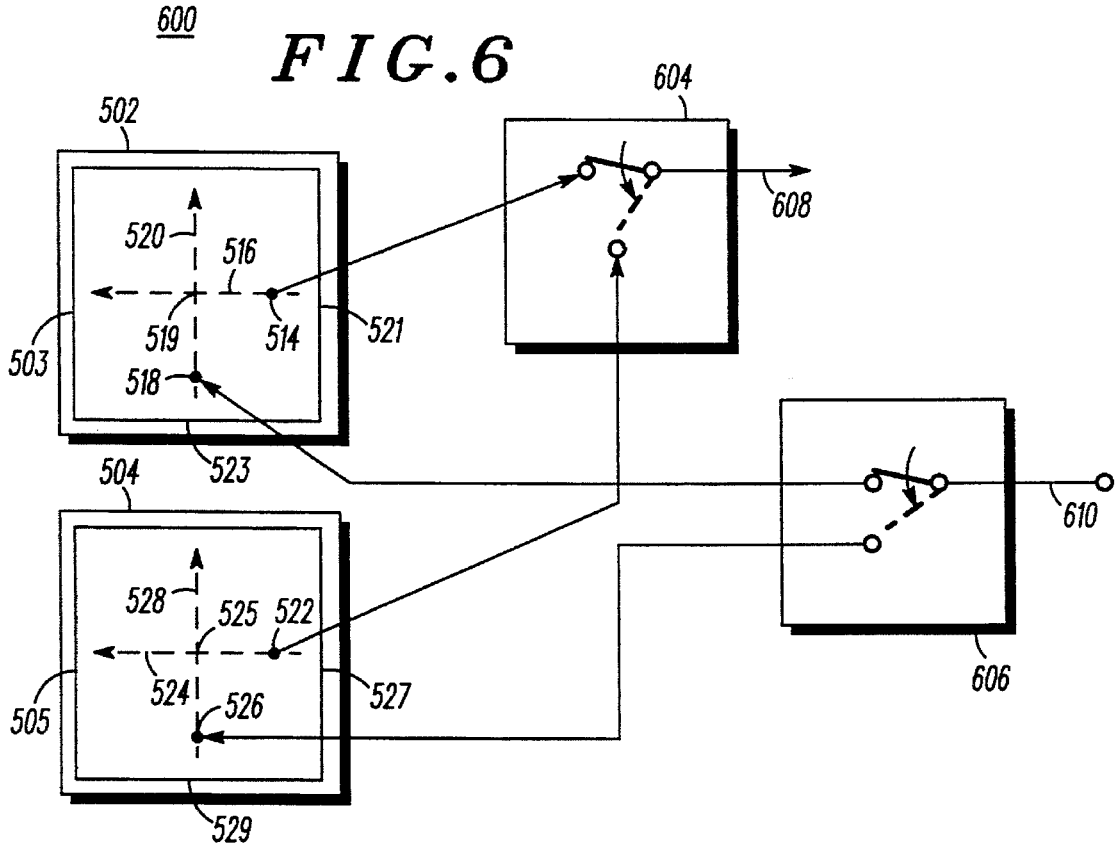
FIG. 6 is a diagram of a fourth embodiment of a dual rectangular patch antenna system for providing isolation and diversity in accordance with the present invention.

FIG. 5, numeral 500, is a diagram of a third embodiment of a dual rectangular patch antenna system for providing isolation and diversity in accordance with the present invention. FIG. 6, numeral 600, is a diagram of a fourth embodiment of a dual rectangular patch antenna system for providing isolation and diversity in accordance with the present invention. Both systems comprise a first rectangular patch antenna (502), a second rectangular patch antenna (504), a first switch (506 and 604), and a second switch (508 and 606). The difference between the systems shown in FIG. 5 and FIG. 6 is the connection scheme for the first and second switches (506, 604, 508, and 606).

The first rectangular patch antenna (502) has a top layer that is a substantially planar conductive rectangular first patch (503) with four coplanar sides, a first midline, and a second midline. The first midline is orthogonal to a first side (523) of the first patch (503), and the second midline is parallel to the first side (523) of the first patch (503) and intersects the first midline at a center (519) of the first patch (503). The first patch (503) comprises a first mode feedpoint (518) for providing a first mode polarization (520) and a second mode feedpoint (514) for providing a second mode polarization (516) orthogonal to the first mode polarization (520). The first mode feedpoint (518) and the second mode feedpoint (514) are located such that an isolation is provided by a voltage null of the first mode polarization (520) along the second midline and a voltage null of the second mode polarization along the first midline. The first mode feedpoint (518) is located on the first midline between the first side (523) and the center (519) of the first patch, and the second mode feedpoint (514) is located on the second midline between a second side (521) and the center (519) of the first patch (503). The first side (523) is adjacent and orthogonal to the second side (521).

The second rectangular patch antenna (504) is spatially separated from the first rectangular patch antenna (502) and has a top layer that is a substantially planar conductive rectangular second patch (505) with four coplanar sides, a third midline, and a fourth midline. The third midline is orthogonal to a first side (529) of the second patch (505), and the second midline is parallel to the first side (529) of the second patch and intersects the first midline at a center (525)

of the second patch. The second patch (505) comprises a third mode feedpoint (526) for providing a third mode polarization (528) and a fourth mode feedpoint (522) for providing a fourth mode polarization (524) orthogonal to the third mode polarization (528). The third mode feedpoint (526) and the fourth mode feedpoint (522) are located such that an isolation is provided by a voltage null of the third mode polarization (528) along the fourth midline and a voltage null of the second mode polarization along the third midline. The third mode feedpoint (526) is located on the first midline between the first side (529) and the center (525) of the second patch, and the fourth mode feedpoint (522) is located on the fourth midline between a second side (527) and the center (525) of the second patch (505). The first side (529) is adjacent and orthogonal to the second side (527).

In FIG. 5, the first switch (506) is operably coupled to select one of the second mode feedpoint (514) of the first rectangular patch antenna (502) and the third mode feedpoint (526) of the second rectangular patch antenna (504) for providing spatial diversity and polarization diversity in the receive path (510). The second switch (508) is operably coupled to select one of the first mode feedpoint (518) of the first rectangular patch antenna (502) and the fourth mode feedpoint (522) of the second rectangular patch antenna (504) for providing spatial diversity and polarization diversity in the transmit path (512).

In FIG. 6, the first switch (604) is operably coupled to select one of the second mode feedpoint (514) of the first rectangular patch antenna (502) and the fourth mode feedpoint (522) of the second rectangular patch antenna (504) for providing spatial diversity in the receive path (608). The second switch (606) is operably coupled to select one of the first mode feedpoint (518) of the first rectangular patch antenna (502) and the third mode feedpoint (526) of the second rectangular patch antenna (504) for providing spatial diversity in the transmit path (610). This arrangement is advantageous for applications where the first rectangular patch antenna and the second rectangular patch antenna do not lie on the same plane since pattern diversity is provided.

The selection made by the switches is based on one or more predetermined signal qualities. Well known diversity algorithms may use received signal strength indication, RSSI, to determine the best antenna to use.

Figure 7:
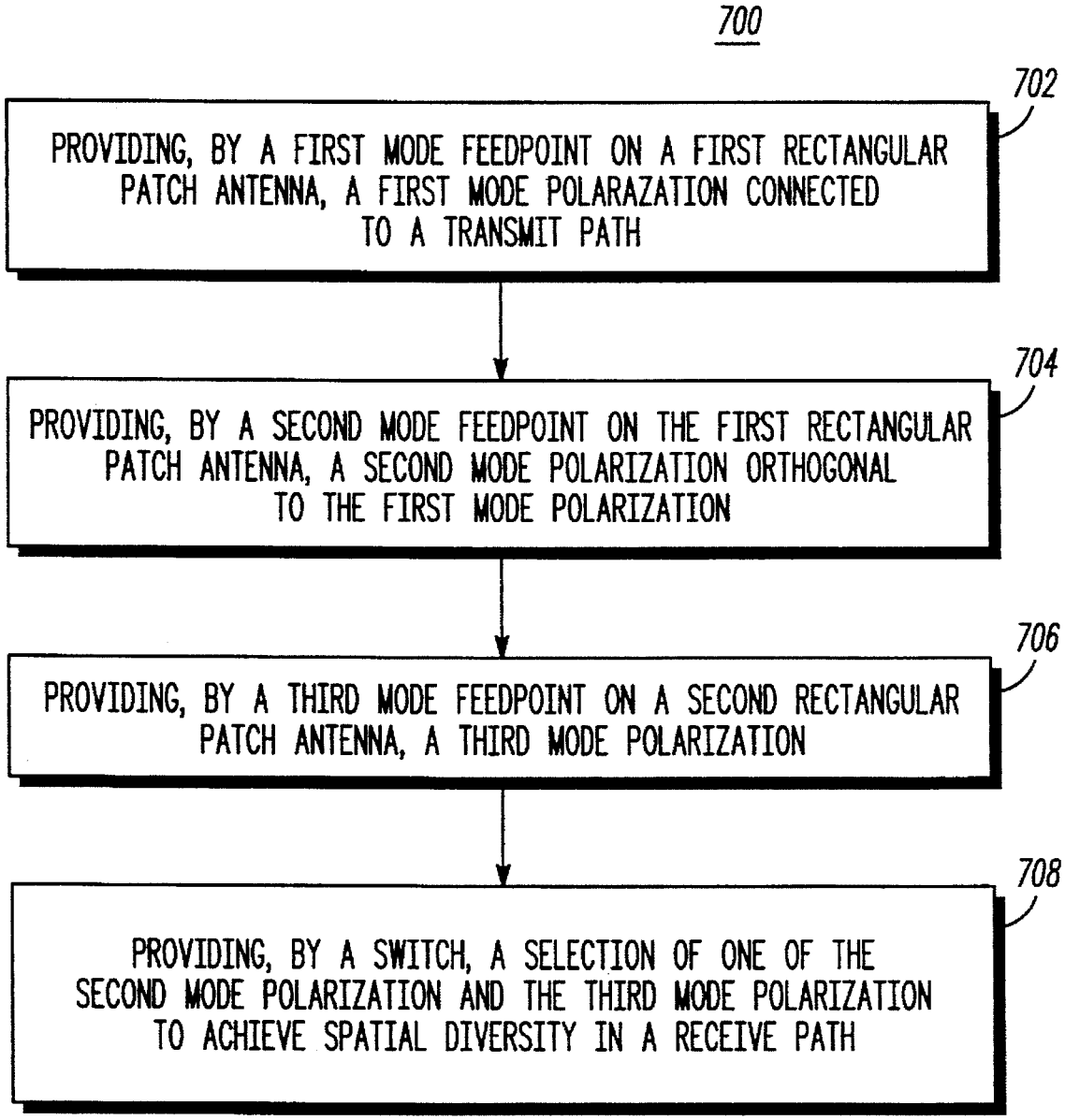
FIG. 7 is a flow diagram of one embodiment of a method for providing isolation and diversity in accordance with the present invention.

FIG. 7, numeral 700, is a flow diagram of one embodiment of a method for providing isolation and diversity in accordance with the present invention. The first step is providing, by a first mode feedpoint on a first rectangular patch antenna, a first mode polarization (702). The second step is providing, by a second mode feedpoint on a first rectangular patch antenna, a second mode polarization orthogonal to the first mode polarization (704). The first mode feedpoint and the second mode feedpoint are located such that an isolation is provided by a voltage null of the first mode polarization in the middle of the first rectangular patch antenna along a line perpendicular to the first mode polarization and a voltage null of the second mode polarization in the middle of the first rectangular patch antenna along a line perpendicular to the second mode polarization. The third step is providing, by a third mode feedpoint on a second rectangular patch antenna, a third mode polarization, wherein the second rectangular patch antenna is spatially separated from the first rectangular patch antenna (706). The fourth step is providing, by a switch, a selection of either the second mode polarization or the third mode polarization to provide spatial diversity in the receive path (708).

The third mode polarization may be orthogonal to the first mode polarization to provide signal isolation in the receive path in a full-duplex system. Alternatively, the third mode polarization may be orthogonal to the second mode polarization to provide polarization diversity in the receive path. The selection of either the second mode polarization or the third mode polarization is made based on a predetermined signal quality. Well known diversity algorithms may use received signal strength indication, RSSI, to determine the best antenna to use.

Figure 8:
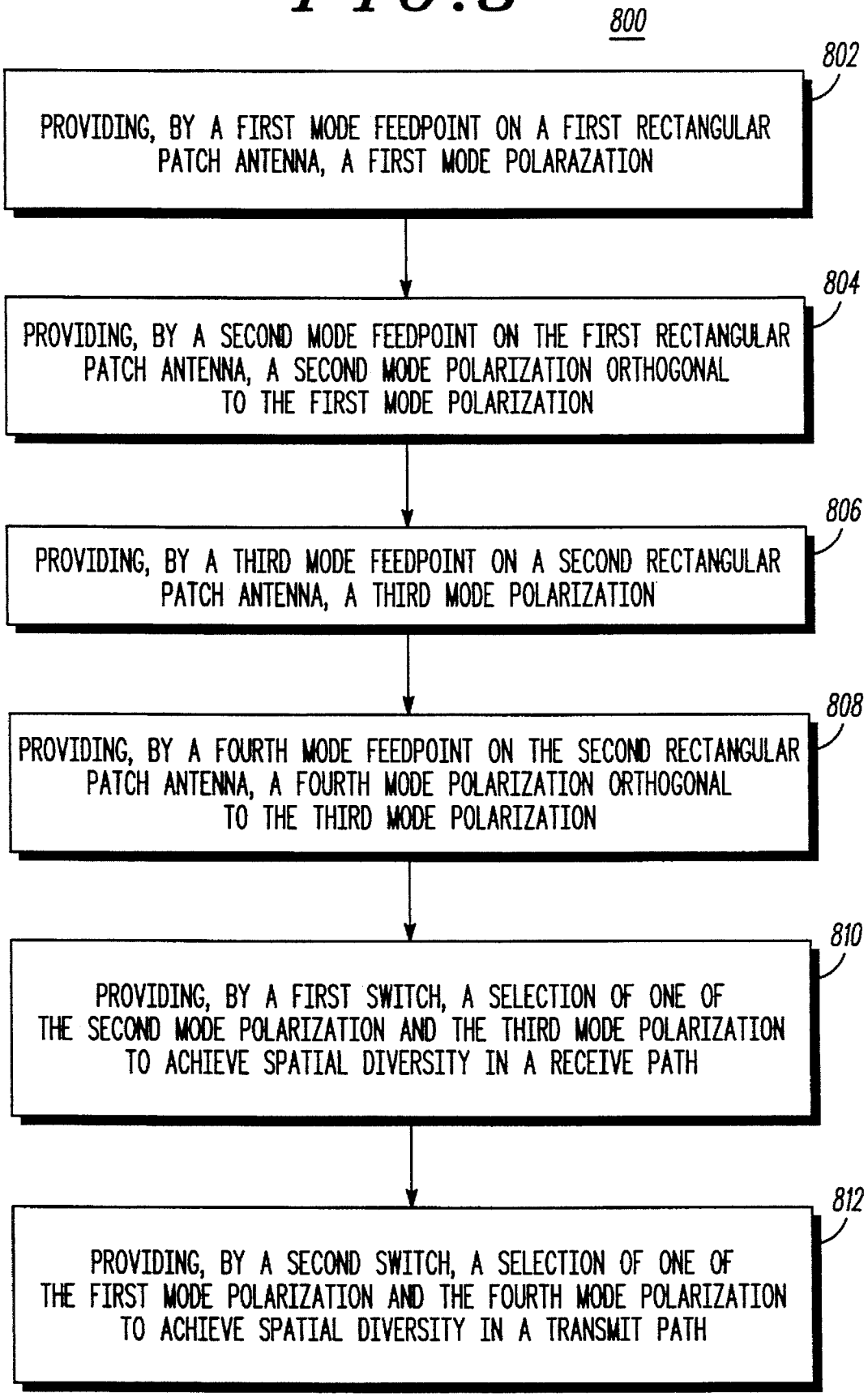
FIG. 8 is a flow diagram of a second embodiment of a method for providing isolation and diversity in accordance with the present invention.

FIG. 8, numeral 800, is a flow diagram of a second embodiment of a method for providing isolation and diversity in accordance with the present invention. The first step is providing, by a first mode feedpoint on a first rectangular patch antenna, a first mode polarization (802). The second step is providing, by a second mode feedpoint on a first rectangular patch antenna, a second mode polarization orthogonal to the first mode polarization (804). The first mode feedpoint and the second mode feedpoint are located such that an isolation is provided by a voltage null of the first mode polarization in the middle of the first rectangular patch antenna along a line perpendicular to the first mode polarization and a voltage null of the second mode polarization in the middle of the first rectangular patch antenna along a line perpendicular to the second mode polarization. The third step is providing, by a third mode feedpoint on a second rectangular patch antenna, a third mode polarization (806). The fourth step is providing, by a fourth mode feedpoint on a second rectangular patch antenna, a fourth mode polarization orthogonal to the third mode polarization (808). The third mode feedpoint and the fourth mode feedpoint are located such that an isolation is provided by a voltage null of the third mode polarization in the middle of the second rectangular patch antenna along a line perpendicular to the third mode polarization and a voltage null of the fourth mode polarization in the middle of the second rectangular patch antenna along a line perpendicular to the fourth mode polarization. The fifth step is providing, by a first switch, a selection between one of the second mode feedpoint of the first rectangular patch antenna and the third mode feedpoint of the second rectangular patch antenna to provide spatial diversity in the receive path (810). The sixth step is providing, by a second switch, a selection of either the first mode polarization or the fourth mode polarization to provide spatial diversity in the transmit path (812).

The selection of either the second mode polarization or the third mode polarization is made based on a first predetermined signal quality. The selection of either the first mode polarization or the fourth mode polarization is made based on a second predetermined signal quality which may or may not be the same as the first predetermined signal quality. Well known diversity algorithms may use received signal strength indication, RSSI, to determine the best antenna to use.

Figure 9:
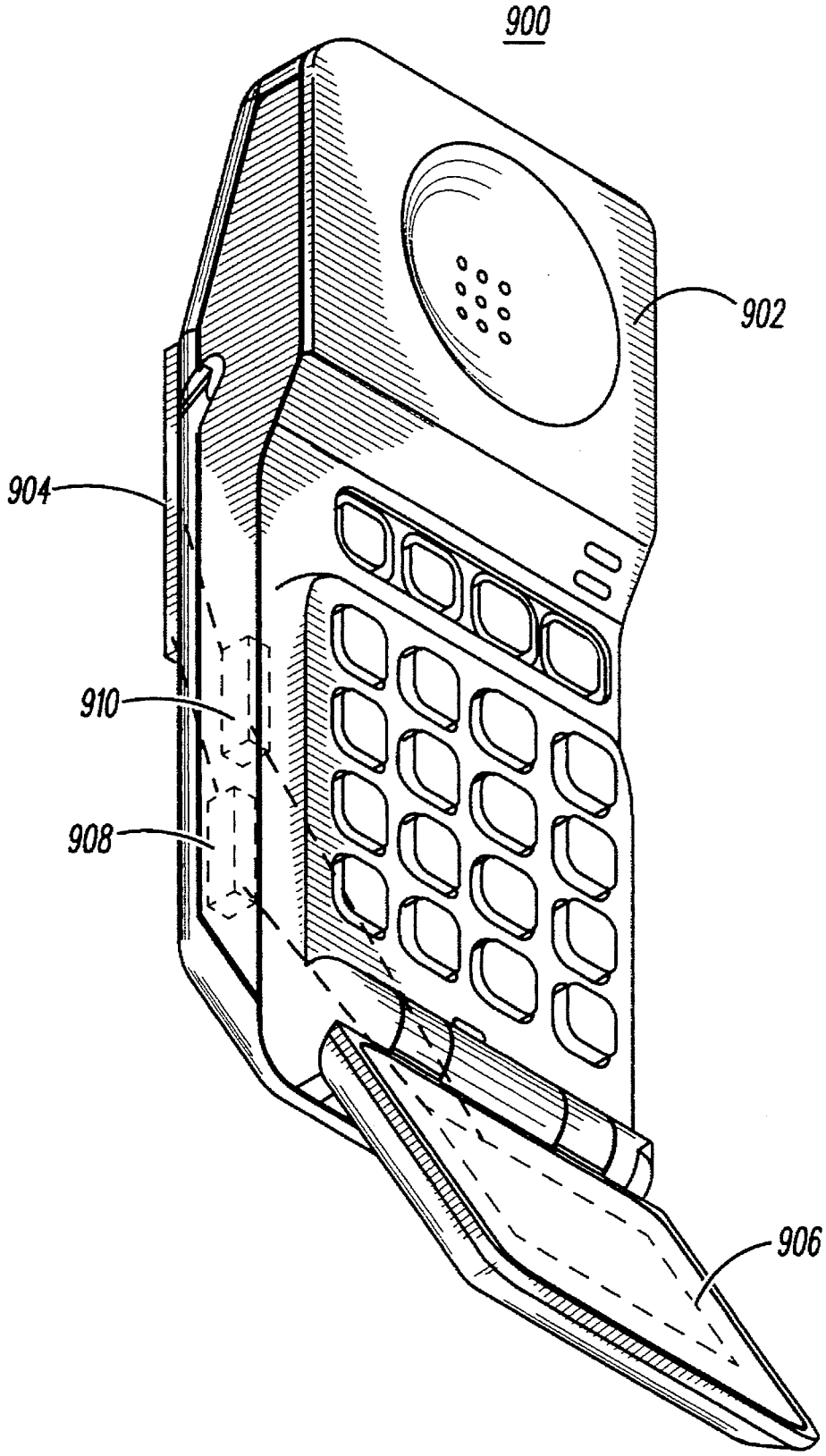
FIG. 9 is a diagram of a preferred embodiment of a radio having a dual rectangular patch antenna system for providing isolation and diversity in accordance with the present invention.

FIG. 9, numeral 900, is a diagram of a preferred embodiment of a radio having a dual rectangular patch antenna system for providing isolation and diversity in accordance with the present invention. Two physically separated patch antennas (904 and 906) can be connected to switches (908 and 910) and mounted on a radio handset (902). The radio (902) can transmit and receive on either antenna (904 and 906) simultaneously while incurring only one switch loss, that being the loss of the switch in both the transmit and receive paths that directs the transmitted and received signal to the desired antenna. Typical arrangements have a switch to select the antenna and another switch to select transmit or receive. With one less switch in the path, the radio (902) exhibits a higher receiver sensitivity as well as a higher radiated power for a given transmitter amplifier output, while allowing for simultaneous transmit and receive. One patch antenna (904) may be mounted on the back of the handset located such that it is not obscured by the hand of the operator, while the second patch antenna (906) may be placed in a flip portion at the radio's base. This arrangement provides a degree of space, pattern, and polarization diversity.

In applications that require only receive diversity, this invention allows the elimination of all switches or diplexer connections from the transmit path, thus maximizing radiated power for a given transmitter amplifier output. This is important for controlling cost and current drain in microwave applications such as RLANs, since a lossy transmit path increases the power requirement of the transmitter amplifier for a given effective radiated power.

Although exemplary embodiments are described above, it will be obvious to those skilled in the art that many alterations and modifications may be made without departing from the invention. For example, the feedpoint that has been described is a probe feed, but those skilled in the art will recognize that any possible alternative feed structure, such as an aperture feed, microstrip conductive feed, or electromagnetic field proximity feed may also be employed to couple energy to and from the antenna. Similarly, any antenna structure that exhibits isolation and field diversity, such as crossed dipoles, crossed inverted-F or crossed slots/apertures, or antennas that implement combinations of left hand/right hand elliptical polarization, may serve as the radiating structure. It is acknowledged that design tradeoffs can be made with modified probe locations that alter achievable isolation. Accordingly, it is intended that all such alterations and modifications be included within the spirit and scope of the invention as defined in the appended claims.

We claim:

1. A dual rectangular patch antenna system for providing isolation and diversity comprising:

A) a first rectangular patch antenna having a substantially planar conductive rectangular first patch with four coplanar sides, a first midline orthogonal to a first side, and a second midline parallel to the first side and intersecting the first midline at a center of the first patch, wherein the first patch includes:

Aa1) a first mode feedpoint, located on the first midline between the first side and the center of the first patch, for providing a first mode polarization, wherein the first mode feedpoint is connected to a transmit path; and A2) a second mode feedpoint, located on the second midline between a second side, adjacent to the first side, and the center of the first patch, for providing a second mode polarization orthogonal to the first mode polarization, wherein the first mode feedpoint and the second mode feedpoint are located such that an isolation is provided by a voltage null of the first mode polarization along the second midline and a voltage null of the second mode polarization along the first midline;

B) a second rectangular patch antenna, spatially separated from the first rectangular patch antenna, having a substantially planar conductive rectangular second patch including a third mode feedpoint for providing a third mode polarization; and C) a switch, operably coupled to select one of the second mode feedpoint of the first rectangular patch antenna and the third mode feedpoint of the second rectangular patch antenna based on a predetermined signal quality, for providing spatial diversity in a receive path.

2. The dual rectangular patch antenna system of claim 1, wherein the third mode polarization is orthogonal to the first mode polarization to provide signal isolation between a transmit and a receive path in a full-duplex system.

3. The dual rectangular patch antenna system of claim 1, wherein the third mode polarization is orthogonal to the second mode polarization to provide polarization diversity in the receive path.

4. The dual rectangular patch antenna system of claim 1, wherein the second patch has four coplanar sides, a third midline orthogonal to a first side of the second patch, and a fourth midline parallel to the first side of the second patch and intersecting the third midline at a center of the second patch, the second patch includes:

B1) the third mode feedpoint, located on the third midline between the first side of the second patch and the center of the second patch, for providing a third mode polarization; and B2) a fourth mode feedpoint, located on the fourth midline between a second side, adjacent to the first side, of the second patch and the center of the second patch, for providing a fourth mode polarization orthogonal to the third mode polarization, wherein the third mode feedpoint and the fourth mode feedpoint are located such that an isolation is provided by a voltage null of the third mode polarization along the fourth midline and a voltage null of the fourth mode polarization along the third midline.

5. The dual rectangular patch antenna system of claim 4, wherein the system further comprises a second switch, operably coupled to select one of the first mode feedpoint of the first rectangular patch antenna and the fourth mode feedpoint of the second rectangular patch antenna based on a second predetermined signal quality, for providing spatial diversity in the transmit path.

6. A method for providing isolation and diversity comprising:

A) providing, by a first feed point on a first rectangular patch antenna, a first mode polarization connected to a transmit path;

B) providing, by a second feedpoint on the first rectangular patch antenna, a second mode polarization orthogonal to the first mode polarization and isolated from the first mode polarization;

C) providing, by a third feedpoint on a second rectangular patch antenna, a third mode polarization, wherein in the second rectangular patch antenna is spatially separated from the first rectangular patch antenna; and D) providing, by a switch, a selection of one of the second mode polarization and the third mode polarization based on a predetermined signal quality to provide spatial diversity in a receive path.

7. The method of claim 6, wherein the third mode polarization is orthogonal to the first mode polarization to provide signal isolation between the transmit path and the receive path in a full-duplex system.

8. The method of claim 6, wherein the third mode polarization is orthogonal to the second mode polarization to provide polarization diversity in the receive path.

9. The method of claim 6, wherein the method further comprises:

E) providing, by a fourth feedpoint on the second rectangular patch antenna, a fourth mode polarization orthogonal to the third mode polarization and isolated from the third mode polarization; and F) providing, by a second switch, a selection of one of the first mode polarization and the fourth mode polarization based on a second predetermined signal quality to provide spatial diversity in the transmit path.

10. A dual rectangular patch antenna system for providing isolation and diversity comprising:

A) a first rectangular patch antenna having a substantially planar conductive rectangular first patch with four coplanar sides, a first midline orthogonal to a first side, and a second midline parallel to the first side and intersecting the first midline at a center of the first patch, wherein the first patch includes:

A1) a first mode feedpoint, located on the first midline between the first side and the center of the first patch, for providing a first mode polarization, wherein the first mode feedpoint is connected to a transmit path; and A2) a second mode feedpoint, located on the second midline between a second side, adjacent to the first side, and the center of the first patch, for providing a second mode polarization orthogonal to the first mode polarization, wherein the first mode feedpoint and the second mode feedpoint are located such that an isolation is provided by a voltage null of the first mode polarization along the second midline and a voltage null of the second mode polarization along the first midline;

B) a second rectangular patch antenna, spatially separated from the first rectangular patch antenna, having a substantially planar conductive rectangular second patch with four coplanar sides, a third midline orthogonal to a first side of the second patch, and a fourth midline parallel to the first side of the second patch and intersecting the third midline at a center of the second patch, wherein the second patch includes:

B1) the third mode feedpoint, located on the third midline between the first side of the second patch and the center of the second patch, for providing a third mode polarization; and B2) a fourth mode feedpoint, located on the fourth midline between a second side, adjacent to the first side, of the second patch and the center of the second patch, for providing a fourth mode polarization orthogonal to the third mode polarization, wherein the third mode feedpoint and the fourth mode feedpoint are located such that an isolation is provided by a voltage null of the third mode polarization along the fourth midline and a voltage null of the fourth mode polarization along the third midline;

C) a first switch, operably coupled to select one of the second mode feedpoint of the first rectangular patch antenna and the third mode feedpoint of the second rectangular patch antenna based on a predetermined signal quality, for providing spatial diversity in a receive path; and D) a second switch, operably coupled to select one of the first mode feedpoint of the first rectangular patch antenna and the fourth mode feedpoint of the second rectangular patch antenna based on a second predetermined signal quality, for providing spatial diversity in the transmit path.

11. The dual rectangular patch antenna system of claim 10, wherein the second mode polarization is orthogonal to the third mode polarization to provide polarization diversity in the receive path.

12. The dual rectangular patch antenna system of claim 10, wherein the first mode polarization is orthogonal to the fourth mode polarization to provide polarization diversity in the transmit path.

13. A method for providing isolation and diversity comprising:

A) providing, by a first feedpoint on a first rectangular patch antenna, a first mode polarization connected to a transmit path;

B) providing, by a second feedpoint on the first rectangular patch antenna, a second mode polarization orthogonal to the first mode polarization and isolated from the first mode polarization;

C) providing, by a third feedpoint on a second rectangular patch antenna, a third mode polarization, wherein in the second rectangular patch antenna is spatially separated from the first rectangular patch antenna; and D) providing, by a fourth feedpoint on the second rectangular patch antenna, a fourth mode polarization orthogonal to the third mode polarization and isolated from the third mode polarization;

E) providing, by a first switch, a selection of one of the second mode polarization and the third mode polarization based on a predetermined signal quality to provide spatial diversity in a receive path; and F) providing, by a second switch, a selection of one of the first mode polarization and the fourth mode polarization based on a second predetermined signal quality to provide spatial diversity in the transmit path.

14. The method of claim 13, wherein the second mode polarization is orthogonal to the third mode polarization to provide polarization diversity in the receive path.

15. The method of claim 13, wherein the first mode polarization is orthogonal to the fourth mode polarization to provide polarization diversity in the transmit path.

16. A radio having a dual rectangular patch antenna system for providing isolation and diversity, the dual rectangular patch antenna system comprising:

A) a first rectangular patch antenna having a substantially planar conductive rectangular first patch with four coplanar sides, a first midline orthogonal to a first side, and a second midline parallel to the first side and intersecting the first midline at a center of the first patch, wherein the first patch includes:

A1) a first mode feedpoint, located on the first midline between the first side and the center of the first patch, for providing a first mode polarization, wherein the first mode feedpoint is connected to a transmit path; and A2) a second mode feedpoint, located on the second midline between a second side, adjacent to the first side, and the center of the first patch, for providing a second mode polarization orthogonal to the first mode polarization, wherein the first mode feedpoint and the second mode feedpoint are located such that an isolation is provided by a voltage null of the first mode polarization along the second midline and a voltage null of the second mode polarization along the first midline;

B) a second rectangular patch antenna, spatially separated from the first rectangular patch antenna, having a substantially planar conductive rectangular second patch with four coplanar sides, a third midline orthogonal to a first side of the second patch, and a fourth midline parallel to the first side of the second patch and intersecting the third midline at a center of the second patch, wherein the second patch includes:

B1) the third mode feedpoint, located on the third midline between the first side of the second patch and the center of the second patch, for providing a third mode polarization; and B2) a fourth mode feedpoint, located on the fourth midline between a second side, adjacent to the first side, of the second patch and the center of the second patch, for providing a fourth mode polarization orthogonal to the third mode polarization, wherein the third mode feedpoint and the fourth mode feedpoint are located such that an isolation is provided by a voltage null of the third mode polarization along the fourth midline and a voltage null of the fourth mode polarization along the third midline;

C) a first switch, operably coupled to select one of the second mode feedpoint of the first rectangular patch antenna and the third mode feedpoint of the second rectangular patch antenna based on a predetermined signal quality, for providing spatial diversity in a receive path; and D) a second switch, operably coupled to select one of the first mode feedpoint of the first rectangular patch antenna and the fourth mode feedpoint of the second rectangular patch antenna based on a second predetermined signal quality, for providing spatial diversity in the transmit path.

* * * * *